United States Patent [19]

Stang

[11] Patent Number: 4,946,094

[45] Date of Patent: Aug. 7, 1990

[54] CONTAINER SYSTEM

[76] Inventor: Michael A. Stang, 26 Stockmill Rd., Apt. F, Pikesville, Md. 21208

[21] Appl. No.: 246,678

[22] Filed: Sep. 20, 1988

[51] Int. Cl.[5] ..... A45F 5/00

[52] U.S. Cl. ..... 224/270; 224/148; 224/202; 224/236; 224/246; 224/906; 206/542; 206/549; 206/178; 248/311.2

[58] Field of Search ..... 224/270, 148, 202, 205, 224/235, 236, 241, 249, 257, 151, 42.45 R, 42.46 R, 242, 245, 246, 250, 906, 901; 229/190, 178, 41 A, 52 PC, 52 AL; 2/49 A, 49 R, 46; 248/312, 312.1, 205.3, 359 A, 318, 311.2, 444; 206/542, 549, 478; 108/43, 46; 211/89, 70.6; 220/85 H

[56] References Cited

U.S. PATENT DOCUMENTS

| | | | |
|---|---|---|---|
| 1,569,157 | 1/1926 | Thompson | 224/249 |
| 2,265,690 | 12/1941 | Fiedler | 2/49 A |
| 2,426,484 | 8/1947 | Buffenbarger | 224/906 |
| 2,637,518 | 5/1953 | Young | 248/312 |
| 2,704,625 | 3/1955 | Huse | 224/906 |
| 2,833,458 | 5/1958 | Toensmeier | 229/41 B |
| 2,844,141 | 7/1958 | Daugherty | 206/542 |
| 3,090,330 | 5/1963 | Best | 224/270 |
| 3,640,380 | 2/1972 | Huffman | 229/52 B |
| 4,489,879 | 12/1984 | Mode | 229/904 |
| 4,754,903 | 7/1988 | Dennis | 224/205 |

*Primary Examiner*—Linda J. Sholl

*Attorney, Agent, or Firm*—Morton J. Rosenberg; David I. Klein

[57] ABSTRACT

This invention pertains to a container system (10) which is adapted to be removably coupled to the body (20) of a user (22). The container system (10) includes a container housing (24) and a cover member (48) having a cut-out portion (60) which is adapted to be contiguously mounted around the neck of the user. The container system (10) includes a releasable coupling mechanism (64) having a strap member (66) which is passed around the neck (62) of the user (22) and is of adjustable length to accomodate differing sized users (22). In this manner, there is provided a container system (10) which is disposable by the user (22) after use and is releasably secured in an adjustable manner around the neck (62) of the user (22) to perform a bib-like function and serve as a temporary table or tray for the objects being used.

17 Claims, 3 Drawing Sheets

CONTAINER SYSTEM

BACKGROUND OF THE INVENTION

1. FIELD OF THE INVENTION

This invention directs itself to a container system adapted to be removably coupled to the body of a user. In particular, this invention relates to a container system having a container housing which is compartmented to allow insert of packaged and unpackaged foodstuffs. Still further, this invention directs itself to a container system having a container housing with a container top cover which is displaceable to an open position and a closed position. More in particular, this invention relates to a container system having a cover which includes a mechanism for releasably coupling the container system to a user's body. Still further, this invention directs itself to a container system wherein a mechanism for releasably coupling the container to the user's body includes a strap member which is fixedly secured to the top cover member of the container system and provides for an opposing end of the strap member which is adjustably mounted around the neck of a user. Additionally, this invention relates to a container system wherein there is provided a strap member which passes through a wedge-shaped slit in the cover of the container system and may be releasably secured therein. Further, this invention relates to a container system which provides for a storage mechanism for an adjustable tape member to releasably mount the tape member to the cover of the container system. Additionally, this invention relates to a container system having a container housing within which is provided a compartment for insert of a cup member. Further, this invention relates to a container system wherein the cup containing compartment is adjustable to a variety of external diameter cups.

2. PRIOR ART

Container systems for containing objects and which are releasably attachable to a user's body are known in the art. The best prior art known to Applicant includes U.S. Patents #3,283,971; #2,597,473; #2,028,825; #798,754; #2,289,945; #1,183,747; #2,523,217; #2,441,115; #4,483,469; #2,277,241; and, #2,312,608.

In some prior art systems such as that shown in U.S. Patent #3,283,971, there is provided a bib-type painter's aid which includes a paint bucket and bib-type apron. Attached to the apron is a halter which may pass around the neck of the user. In such prior art systems, the strap is not adjustable in length and the overall system does not provide for a box type container for containing foodstuffs, as is necessary to the instant subject concept.

In other prior art systems, such as that shown in U.S. Patent #2,497,473, there is provided a combined vanity/make-up case and support. In such prior art systems, there is provided a compartmented box which has a strap attached. However, such prior art systems are not adapted for insert in a contiguous manner around the neck of the user, since the straps pass to the sides of the container and thus are not attached to the cover and further, there is nothing provided for the arcuate cutout to maintain the bib-like system of the subject invention concept.

In other prior art systems such as that shown in U.S. Patent #2,028,825, there are provided service containers which include a strap mounted on opposing sides of the container. Although such prior art does have compartments, the strap is not adjustable and is not coupled to the container cover to allow for the maintaining of the foodstuffs adjacent the body of the user, as is provided in the subject invention concept system.

Other prior art systems such as shown in U.S. Patent #798,754 direct themselves to mailbags which provide for a container type construction having compartments. Although there is a strap provided, such does not provide for the bib-like structure of the system for storing objects, as is provided in the subject concept invention.

Other prior art systems do not provide for adjustable compartment structures to accomodate differing sized diameter containers, as is provided in the subject concept.

SUMMARY OF THE INVENTION

A container system is provided and adapted to be removably coupled to the body of a user. The container system includes a container housing defining an internal housing chamber having an opening formed therein for at least temporarily storing objects. The objects are insertable and removable from the container through the housing opening. A cover member is provided for the container system and is secured to the container housing. Additionally, a releasable coupling mechanism is included in the container system for releasably coupling the container to the user's body.

An object of the subject container system is to provide a disposable container system which includes a container housing for temporarily storing objects therein.

It is a further object of the subject invention to provide an inexpensive, easily manufacturable container system which may be disposed after use.

It is still another object of the subject invention to provide a container system which may be mounted around the neck of the user to facilitate eating of objects contained within the container system within a confined space.

It is another object of the subject invention to provide a container system which performs a bib-like function for the user and ma be disposed of after use.

It is still another object of the invention to provide a container system having a container housing including a plurality of compartments for holding and temporarily storing different sized objects.

It is another object of the subject invention to provide at least one adjustable compartment for holding cup members of differing diameters.

It is an object of the invention to provide an adjustable container which may be adjusted for differing sized and dimensioned users.

DESCRIPTION OF THE PREFERRED EMBODIMENTS

Figure 1:
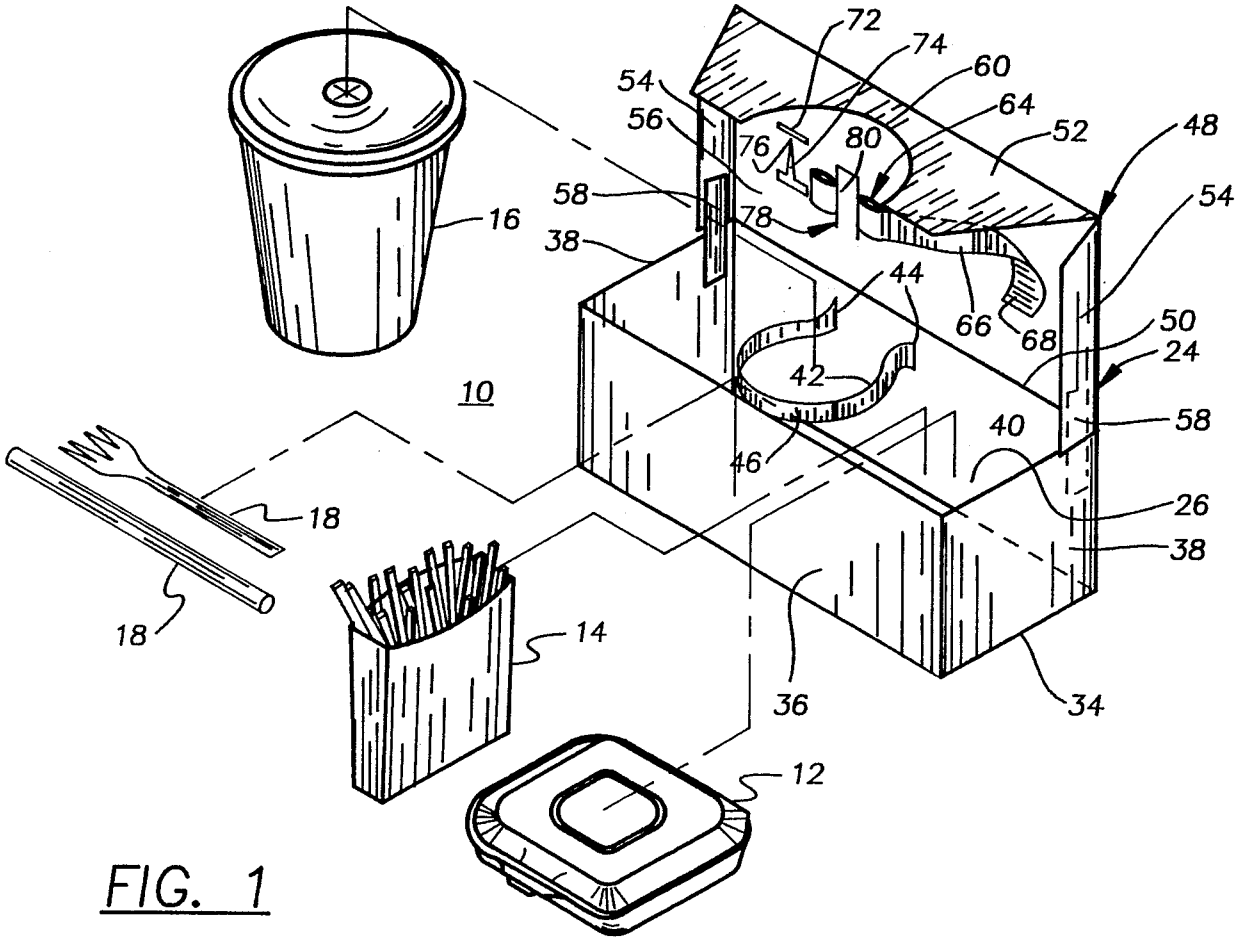
FIG. 1 is a perspective view of the subject container system in an exploded view showing objects contained within the container system.

Referring now to FIGS. 1–5, there is shown container system 10 for temporarily containing a plurality of foodstuffs such as food container 12, fried potato container 14, liquid drink cups 16, as well as utensils 18 a shown in FIG. 1. Although generally directed to fast-food type containment elements, it is to be clearly understood that such representations in FIG. 1 are only representative in nature, and that container system 10 may be adapted to contain a wide variety of containers at the discretion of the user. Additionally, container system 10 may in its component parts be formed of a somewhat rigid plastic system, or cardboard material composition to allow container system 10 to be disposable in use.

Container system 10 may be used in situations where the user has purchased various food products and wishes to eat them in an area where normal sit-down table conditions do not exist. Thus, container system 10 is adapted to be removably coupled to the body 20 of user 22 as is clearly seen in FIGS. 4 and 5. In this way, container system 10 provides for the dual objectives of maintaining a relatively stable containment volume for a plurality of food containers 12, 14, 16 and 18, as well as incorporating therein a personal tray from which the user may easily and simply eat the food contained therein.

Subsequent to use, the various containers and utensils 18 as shown in FIG. 1 may be stored within container system 10. Container system 10 may then be disposed of in an efficient manner. Additionally, although not restricted for the use of juveniles, computer system 10 is of great advantage for use by children in the confined areas of a vehicle. In the manner to be described in following paragraphs, container system 10 is mounted to user's body 20 and during the eating process may be used to catch crumbs, liquid, and other debris thus minimizing cleaning up of the vehicle interior subsequent to eating.

Container system 10 includes container housing 24 defining internal housing chamber 26 having an opening formed in the top thereof, as is seen in FIG. 1 for at least temporarily storing containers 12 and 14, cup 16 and utensils 18. Containers 12 and 14, cup 16, and utensils 18 are reversibly insertable into and out of container housing 24 through the upper opening as is clearly evident.

Figure 2:
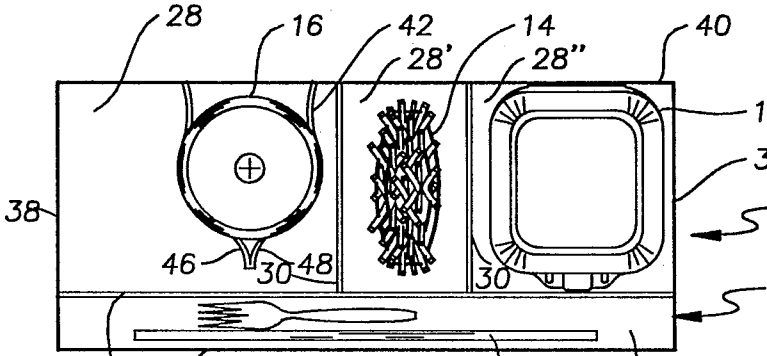
FIG. 2 is a top view of the container system when in the open position with the cover member providing an opening for insert of objects.

Container housing 24 as is shown has a substantially parallelepiped contour and is box shaped although such contour is not important to the inventive concept as is herein described, with the exception that such be of a size and dimension which adequately accepts containers 12 and 14, as well as cup 16 and utensils 18, and further, is adapted to be mounted to the body of user 22. Additionally, container housing 24 is compartmented for storing differing objects in separated compartments 28, 28′, and 28″, as is seen in FIG. 2. Compartment 28‴ may extend throughout a longitudinal length of container housing 24 and provide an insert for utensils 18. Contained within chamber 26 are a plurality of intersecting internal sidewall members secured to housing base 34 for defining compartments 28, 28′, and 28″. Frontal intersecting wall 32 may also be secured to housing base 34 and extends through-out the longitudinal length of container housing 24 to define an elongated insert volume for utensils 18.

Internal sidewalls 30 and frontal internal wall 32 may also be formed of cardboard and secured to the internal walls of container housing 24 by adhesive attachment, or may be formed in one piece formation therewith, or otherwise coupled in some like manner. The important concept being that chamber 26 within container housing 24 be divided into a plurality of compartments 28, 28′, 28″, and 28‴ to provide a separated volume space for each of containers 12 and 14, as well as cup 16 and utensils 18.

As has been shown, container housing 24 may thus be formed of housing base 34 which intersects in a substantially orthogonal manner with housing container front wall 36 and container housing rear wall 40 and further, in orthogonal relationship with opposing container housing sidewalls 38. In this manner, an overall box-like contour is provided for container housing 24. Container wall members 34, 36, 38 and 40 may be formed of a single blank and adhesively secured together or may be folded into appropriate contour not important to the inventive concept as herein described.

Cup member 16 is generally adapted to contain liquid and thus may be more unstable than other food containers, such as members 12 and 14. In order to minimize spilling of the liquid contained within cup member 16, there is provided cup holding strap member 42 which includes opposing end sections 44 secured to container housing rear wall 40, as is seen in FIGS. 1 and 2. Thus, cup holding strap member 42 extends into compartment 28 and is adapted to hold cup member 16 therein. In order to provide an adjustment of the length between cup holding strap member opposing ends 44 for securement of cup members having different external diameters, there is provided a central portion strap section 46. Central portion 46 of cup holding strap member 42 may include an adhesive formed on an inner surface throughout a predetermined distance. Central section or portion 46 may be mounted around cup member 46 and pinched to bring adjacent adhesive inner surfaces into contact each with respect to the other to form a force fit of cup member 46 when contained in cup holding strap member 42. Pinched section 48 is shown in FIG. 2 and allows adjustment to provide accomodation of cup member 16 of varying external diameters, as is generally found in commerce. Cup holding strap member 42 may be formed of a paper strip, or a flexible piece of polyethylene plastic material composition.

Container system 10 further includes cover member 48 secured to container housing 24 as is shown in FIGS. 1–4. Cover member 48 may be formed of the same material composition as container housing 24, as has previously been disclosed and described. Cover member 48 is generally hingedly secured to container housing 24 along hinge line 50, as is seen in FIG. 1. In fact, cover member 48 may be formed in one-piece construction with container housing rear wall 40.

Figure 5:
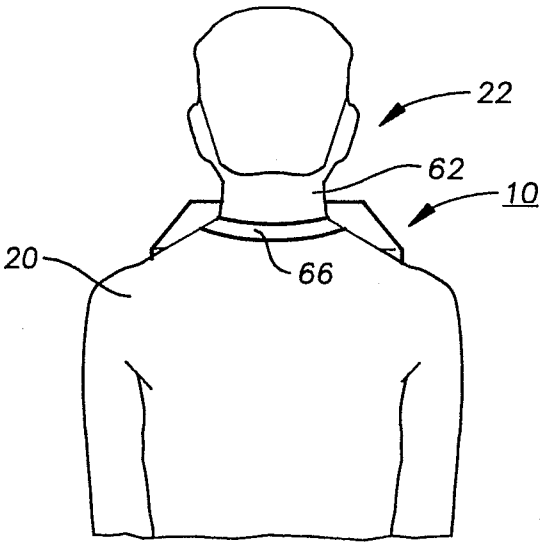

Cover member 48 includes frontal section 52, a pair of opposing side sections 54, and top section 56 for interfacing with container housing chamber 26 to provide a closed volume when cover member 48 is in a closed position. Opposing cover member side sections or walls 54 may be displaceably secured to opposing sidewalls 38 of container housing 24 through use of adhesive tape members 58, as is shown in FIG. 1, which provides for additional constructional stability of container system 10 and allows such to be secured to user 24 in a structurally stable manner when in use as shown in FIGS. 4 and 5.

Cove member 48 includes cut-out portion 60 formed through frontal section 52 in an arcuate contour for interfacing with neck 62 of user 22. In this manner, container system 10 may be mounted on the body of user 22, as shown in FIGS. 4 and 5, and provides for a biblike system to prevent spillage of food particles on the clothing of user 22. As is seen, cut-out portion 60 is generally arcuate in contour and adapted to contiguously interface with a portion of neck 62 of user 22.

Figure 3:
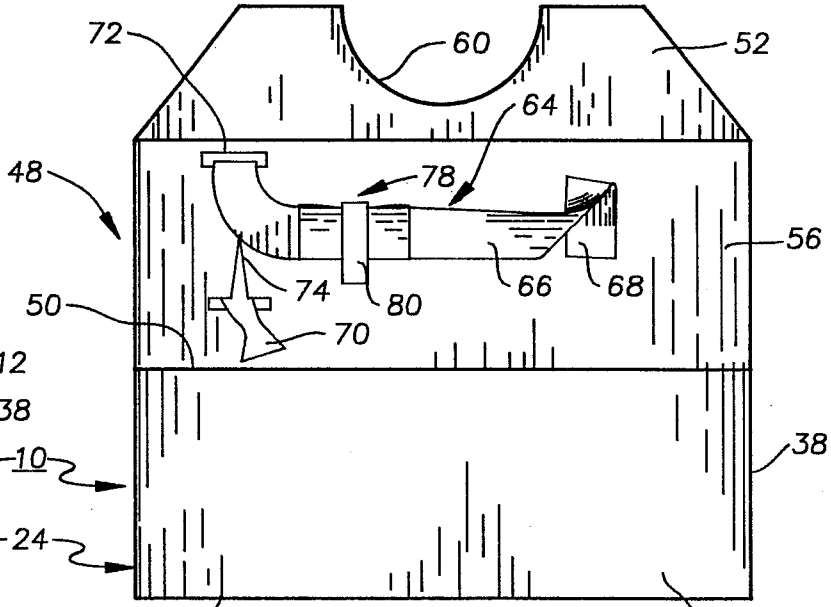
FIG. 3 is a frontal view of the container system with the cover member in an open position.
Figure 4:
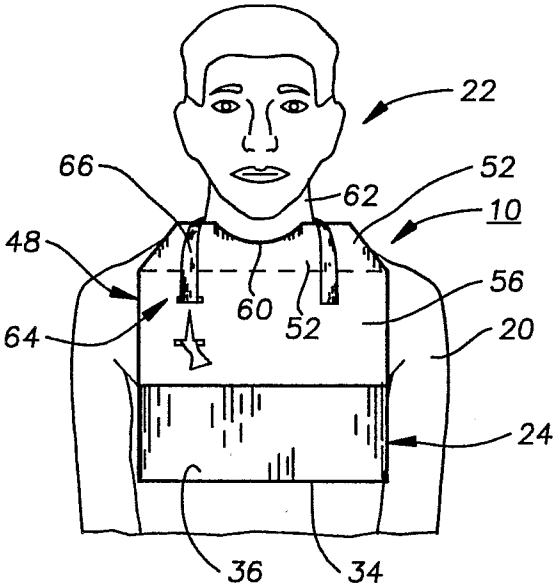
FIG. 4 is a frontal view of the container system showing the container system mounted on the body of a user; and, FIG. 5 is a rear view of the container system mounted on the body of a user.

Container system 10 further includes releasable coupling mechanism 64 shown in FIGS. 1, 3 and 4 for allowing releasable coupling of container housing 24 to user 22. Releasable coupling mechanism 64 includes adjustable strap member 66 for releasable coupling about neck 62, as is shown in FIGS. 4 and 5. Adjustable strap member 66 includes opposing ends 68 and 70 with first strap end 68 being fixedly secured to an inner surface of cover member 48 and in particular, to an inner surface of cover member top section 56, a is shown in FIGS. 1 and 3. First end 68 of strap member 66 may be mounted to cover member top section 56 through adhesive engagement, or some like technique, not important to the inventive concept as herein described, with the exception that end 68 be fixedly secured to cover section 56.

Releasable coupling mechanism 64 further includes a pair of openings or slits 72 and 74 formed in top section 56 for passage of second strap end 70 therethrough. Strap member 66 may be passed through upper slit 72 and then through triangular slit 74 having apex section 76. Second strap end 70 is passed internal to triangular slit 74 and may be wedged in the apex area 76 for securing strap member 66 in a substantially fixed coupling to top section 56 of cover member 48.

Additionally, dependent upon the particular body dimensions of user 22, differing lengths of strap member 66 may be passed through triangular slit 74 to provide a contiguous and mating engagement with user 22, as is shown in FIGS. 4 and 5.

Subsequent to use, strap member 66 may be removed from triangular slit 74 and reinserted into chamber 26 of housing 24 to provide a receptacle therefor.

In this manner, triangularly contoured slot 76 provides for securement of strap member 66 and in particular, its second end 70 to cover member top section 56. The use of a singular slit or a pair of slits, such as 72 and 76 are not important to the inventive concept as herein described, with the exception that there be provided a securement mechanism formed within cover member 48 to allow for adjustability of strap member 66 to user 22.

Additionally, container system 10 includes releasable coupling mechanism 78 formed adjacent cover member 48 to allow for storage of strap member 66 when not in use. As can be seen in FIGS. 1 and 3, releasable coupling mechanism 78 includes tab member 80 secured to an inner surface of cover member 48. Strap member 66 is insertable under tab member 80 for releasably capturing strap member 66 to cover member 48, as is clearly seen in FIG. 1. In this manner, strap member 66 may be mounted prior to use adjacent cover member 48 and may be pulled out of tab member 80 when strap member 66 is to be passed around neck 62 of user 22 for insertion through slit 72 and 74 and then wedged into apex section 76. Tab member 80 may merely be a slit formation formed in top section 56 to provide a holding mechanism for strap member 66 when container system 10 is not in use.

In this manner, and as has previously been described, user 22 may purchase various food containers 12, 14 and 16 and have them inserted into container housing 24. User 22 may then utilize container system 10 as a storage area for containers 12, 14 and 16, as well as utensils 18, prior to use. In use, user 22 may open cover member 48 and release strap member 66 from releasable strap coupling mechanism 78 and adjust such around neck 62, as shown in FIGS. 4 and 5. When the proper adjustment is made, strap member 66 is forced into apex 76 of triangularly shaped slot 74. User 22 may then eat from food containers 12, 14 and 16 while container housing 24 is mounted on their body. After completion of food intake, user 22 may store the used containers within container housing 24 and cover 48 may be closed. The entire container system 10 may then be disposed of in a waste receptacle at the convenience of user 22.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. A container system adapted to be removably coupled to the body of a user, comprising:

(a) a container housing defining an internal housing chamber having an opening formed therein for at least temporarily storing objects therein, said objects being insertable and removable from said container through said housing opening;

(b) a cover member secured to said container housing;

(c) means for releasably coupling said container housing to said user's body, said releasable coupling means including (1) a strap member having one end fixedly secured to said cover member and an opposing strap end adapted to pass around a neck portion of said user for releasable securement to said cover member, and (2) strap adjustment means for releasably coupling said strap member around said neck portion of said user, said strap adjustment means including a slit formed through said cover member for passage therethrough of said strap opposing end for providing securement of said strap member opposing end to said cover member; and, (d) means for releasably storing said releasable coupling means adjacent said cover member, said means for releasably storing said releasable coupling means includes a tab member secured to an inner surface of said cover member, said strap member being insertable under said tab member for releasably capturing said strap member to said cover member, whereby said strap member is stored within said internal housing chamber.

2. The container system as recited in claim 1 where said container housing has a substantially parallelepiped contour.

3. The container system as recited in claim 1 where said container housing chamber is compartmented for storing different objects in separated compartments formed therein.

4. The container system as recited in claim 3 where said housing chamber includes a plurality of intersecting internal wall members secured to a base of said container housing for defining said compartments.

5. The container system as recited in claim 1 where said cover member is hingedly secured to said container housing.

6. The container system as recited in claim 5 where said cover member includes a frontal section, and a pair of opposing side sections, each of said sections being foldable with respect to a top section of said cover member.

7. The container system as recited in claim 6 where said frontal section of said cover member includes a cut-out portion for arcuately interfacing with a neck of said user when said container is coupled to said body of said user.

8. The container system as recited in claim 6 where at least one of said cover member side sections is secured to said container housing.

9. The container system as recited in claim 1 where said cover member includes a cut-out portion for contiguously interfacing with a neck portion of said user, said cover member forming a bib-like member when mounted in coupled relation to said user's body.

10. The container system as recited in claim 9 where said cover cut-out portion is arcuate in contour.

11. The container system as recited in claim 1 where said strap member opposing end is releasably securably inserted through said slit at a predetermined location of said strap member for providing a predetermined strap member loop length passing around said user's neck.

12. The container system as recited in claim 1 including at least one cup holding strap member having a loop configuration and secured to a housing wall for capturing a cup therein, said cup holding strap member having opposing ends secured to said housing wall and a central portion adapted to contiguously interface with a cup member.

13. The container system as recited in claim 12 where said cup holding strap member includes means for adjusting the length between said cup holding strap member opposing ends for securement of cup members having differing external diameters.

14. The container system as recited in claim 13 where said cup holding strap member central portion has adhesive formed on an inner surface throughout a predetermined distance, said central portion being mounted around said cup member, a portion of said adhesive inner surfaces being brought into contact to form a force fit of said cup member in said cup holding strap member.

15. The container system as recited in claim 1 where said container housing and said cover member are formed of a cardboard material composition.

16. The container system as recited in claim 1 where said strap adjustment means further includes a substantially triangularly contoured slit formed through said cover member, said triangular slit having an apex portion for wedgingly receiving said strap member for releasable coupling therewith.

17. A container system adapted to be removably coupled to the body of a user, comprising:

(a) a container housing defining an internal housing chamber having an opening formed therein for at least temporarily storing objects therein, said objects being insertable and removable from said container through said housing opening;

(b) a cover member secured to said container housing;

(c) means for releasably coupling said container housing to said user's body; and, (d) cup holding means secured to a housing wall for capturing a cup therein, said cup holding means including (1) at least one cup holding strap member having a loop configuration and having opposing ends secured to said housing wall and a central portion adapted to contiguously interface with a cup member, and 2) means for adjusting the length between said cup holding strap member opposing ends for securement of cup members having differing external diameteres, said cup holding strap member central portion has adhesive formed on an inner surface throughout a predetermined distance, said central portion being mounted around said cup member, a portion of said adhesive inner surfaces being brought into contact to form a force fit of said cup member in said cup holding strap member.

* * * * *